US008376594B2

(12) United States Patent
Park et al.

(10) Patent No.: US 8,376,594 B2
(45) Date of Patent: Feb. 19, 2013

(54) RECESSED LIGHTING FIXTURE WITH SOCKET ADJUSTMENT MECHANISM

(75) Inventors: John S. Park, Fall River, MA (US); Eugene R. Sartini, Fall River, MA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 378 days.

(21) Appl. No.: 12/612,407

(22) Filed: Nov. 4, 2009

(65) Prior Publication Data

US 2011/0103062 A1 May 5, 2011

(51) Int. Cl.
*F21S 8/02* (2006.01)
*F21V 14/02* (2006.01)

(52) U.S. Cl. ..... 362/418; 362/282; 362/364; 362/147; 362/429

(58) Field of Classification Search ..... 362/364, 362/372, 147, 285, 277, 282, 346, 366, 269, 362/418, 428, 429
See application file for complete search history.

(56) References Cited

U.S. PATENT DOCUMENTS

| | | | | | |
|---|---|---|---|---|---|
| 4,232,361 | A * | 11/1980 | Kelsall | 362/364 |
| 5,222,800 | A * | 6/1993 | Chan et al. | 362/147 |
| 5,823,664 | A * | 10/1998 | Demshki et al. | 362/366 |
| 6,036,337 | A * | 3/2000 | Belfer | 362/287 |
| 6,343,873 | B1 * | 2/2002 | Eberhard et al. | 362/364 |
| 7,303,314 | B2 * | 12/2007 | Jones | 362/282 |
| 7,476,008 | B2 * | 1/2009 | Kay | 362/364 |
| 7,484,866 | B1 * | 2/2009 | Buse | 362/366 |
| 7,654,705 | B2 * | 2/2010 | Czech et al. | 362/364 |
| 2010/0110698 | A1 * | 5/2010 | Harwood et al. | 362/365 |

* cited by examiner

*Primary Examiner* — Peggy A. Neils

(57) ABSTRACT

A recessed luminaire with adjustable socket assembly comprises a housing having a sidewall, a top wall and a lower opening allowing light output, a socket adjustment assembly disposed in the housing, the socket adjustment assembly having: a lamp socket connected to a socket carriage, a track having a socket carriage movably positioned on the track, wherein the carriage moves along the track and the lamp socket is movable in at least one of a vertical or a horizontal direction.

14 Claims, 15 Drawing Sheets

RECESSED LIGHTING FIXTURE WITH SOCKET ADJUSTMENT MECHANISM

TECHNICAL FIELD

The present invention pertains to recessed lighting fixtures. More specifically, the present invention pertains to remodeler recessed lighting fixtures which do not require access above an installed ceiling in order to install the fixture, which receive various reflector types and which provide socket adjustment for the various reflector types.

BACKGROUND

When installing a recessed fixture in a pre-existing ceiling aperture or in a new aperture in an existing ceiling, the size and form of the remodeler fixture is limited by the shape and size of the ceiling aperture, as well as the ceiling thickness and plenum depth. Current fixtures are generally fixed structures which do not allow for variation of size of the fixture housing. Thus lighting designs for remodeler fixtures must be sized to fit through a hole in the ceiling while also allowing for proper positioning of a lamp and socket.

Since the fixture housing is fixed in dimension, there are limitations on the size or positioning of a socket assembly, which holds the lamp. Moreover, the socket assembly for existing fixtures sometimes do not provide for the best positioning of the lamp or lamp socket.

It would be highly desirable to provide a fixture which allows for ease of positioning through a ceiling aperture and which also optimizes positioning of the lamp and socket within the fixture after the socket passes through the ceiling.

It would also be desirable to provide for the use of downlight, wall wash and other types of lighting optics. However, providing for differing optics may also require movement of the lamp and socket to different positions to accommodate the optics, including the differing reflectors. Such system is not currently available. Accordingly, it would also be highly desirable to provide a system which allows use of differing reflector optics as well as providing adjustment to allow for such adjustment capability.

It would be highly desirable to overcome these and other deficiencies in order to provide an improved recessed lighting fixture which may be used in remodeler applications.

SUMMARY

A recessed luminaire with adjustable socket assembly comprises a housing having a sidewall, a top wall and a lower opening allowing light output, a socket adjustment assembly disposed in the housing, the socket adjustment assembly having: a lamp socket connected to a socket carriage, a track having a socket carriage movably positioned on the track, wherein the carriage moves along the track and the lamp socket is movable in at least one of a vertical or a horizontal direction. The recessed luminaire of further comprising a wall wash reflector disposed in said housing. The recessed luminaire wherein the lamp socket and carriage are disposed in one of a first position and a second position corresponding to a lamp aperture position of said wall wash reflector. The recessed luminaire further comprising a downlight reflector. The recessed luminaire wherein the lamp socket and carriage are disposed in one of a first position or a second position corresponding to a lamp aperture position of the downlight reflector. The recessed luminaire further comprising a reflector adjustment assembly. The recessed luminaire wherein the reflector adjustment assembly has a first position corresponding to a first position of the socket adjustment assembly. The recessed luminaire wherein the reflector adjustment assembly has a second position corresponding to a second position of the socket adjustment assembly. The recessed luminaire wherein the reflector adjustment mechanism has a pin which is movable from a first position to a second position. The recessed luminaire wherein the pin is connected to an arm, the arm allowing guided movement of the pin through a slot.

A recessed luminaire with movable lamp socket comprises a housing having a lowermost opening defined by a sidewall, a top wall positioned across an upper portion of the housing to enclose the housing, an adjustable socket assembly including the lamp socket disposed on a movable carriage, the carriage connected to a track for movement in at least one plane, the lamp socket movable from a first position to a second position, one of the first and second positions corresponding to a first reflector and the other of the first and second positions corresponding to a second reflector. The recessed luminaire further comprising a reflector adjustment mechanism disposed within the housing. The recessed luminaire wherein the reflector adjustment mechanism has a movable pin which slides through a slot from a first position to a second position. The recessed luminaire wherein the reflector adjustment mechanism has a first position corresponding to the first position of the lamp socket. The recessed luminaire wherein the reflector adjustment mechanism has a second position corresponding to the second position of the lamp socket. The recessed luminaire wherein the first reflector is one of a wall wash reflector and a downlight reflector. The recessed luminaire wherein the second reflector is the other of the wall wash reflector and the downlight reflector.

A recessed luminaire with a lamp socket assembly allowing movement of a lamp socket, comprises a housing having a sidewall, a lower opening and a removable top wall, the lamp socket assembly being adjustable to receive a first reflector type and a second reflector type, the adjustable lamp socket assembly having a fixed portion and a movable portion, the lamp socket connected to the movable portion, the socket being movable from a first position corresponding to a first reflector type to a second position corresponding to second reflector type, a reflector adjustment mechanism having a first position also corresponding to the first reflector type and a second position corresponding to the second reflector type. The recessed luminaire wherein the adjustable lamp socket assembly and the reflector adjustment mechanism are interlocked so that movement of one of the adjustable lamps socket assembly causes movement of the reflector adjustment mechanism. The recessed luminaire wherein the adjustable lamp socket assembly and the reflector adjustment mechanism each are movable independently of the other.

BRIEF DESCRIPTION OF THE ILLUSTRATIONS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
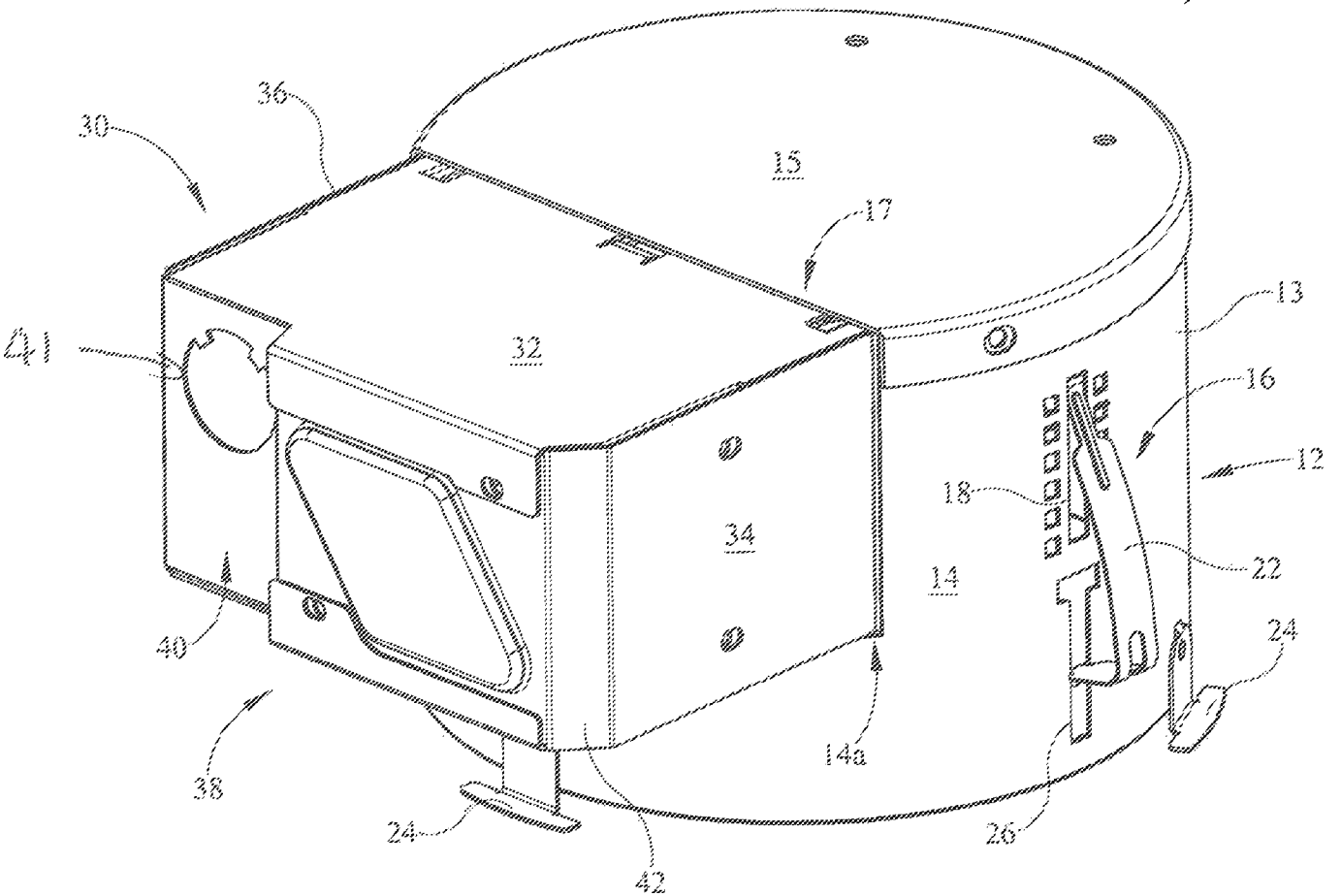
FIG. 1 is an upper perspective view of an exemplary recessed remodeler fixture.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

A recessed remodeler luminaire fixture is shown in the various FIGS. 1-13. The recessed remodeler luminaire fixture utilizes a movable sidewall portion to allow the remodeler fixture to collapse to a smaller size and pass through a ceiling aperture. Once the fixture is in the ceiling, the sidewall may be expanded to properly position the socket and a lamp relative to the fixture opening. The collapsible sidewall portion may be shaped to fit within the periphery of a main housing portion when collapsed so as to pass through the ceiling aperture. Additionally, the fixture may include a movable socket adjustment assembly allowing the movement of the socket to match aperture positions for various corresponding reflector types. Finally, the fixture may be utilized with various reflector types to vary the light output therefrom.

Figure 9:
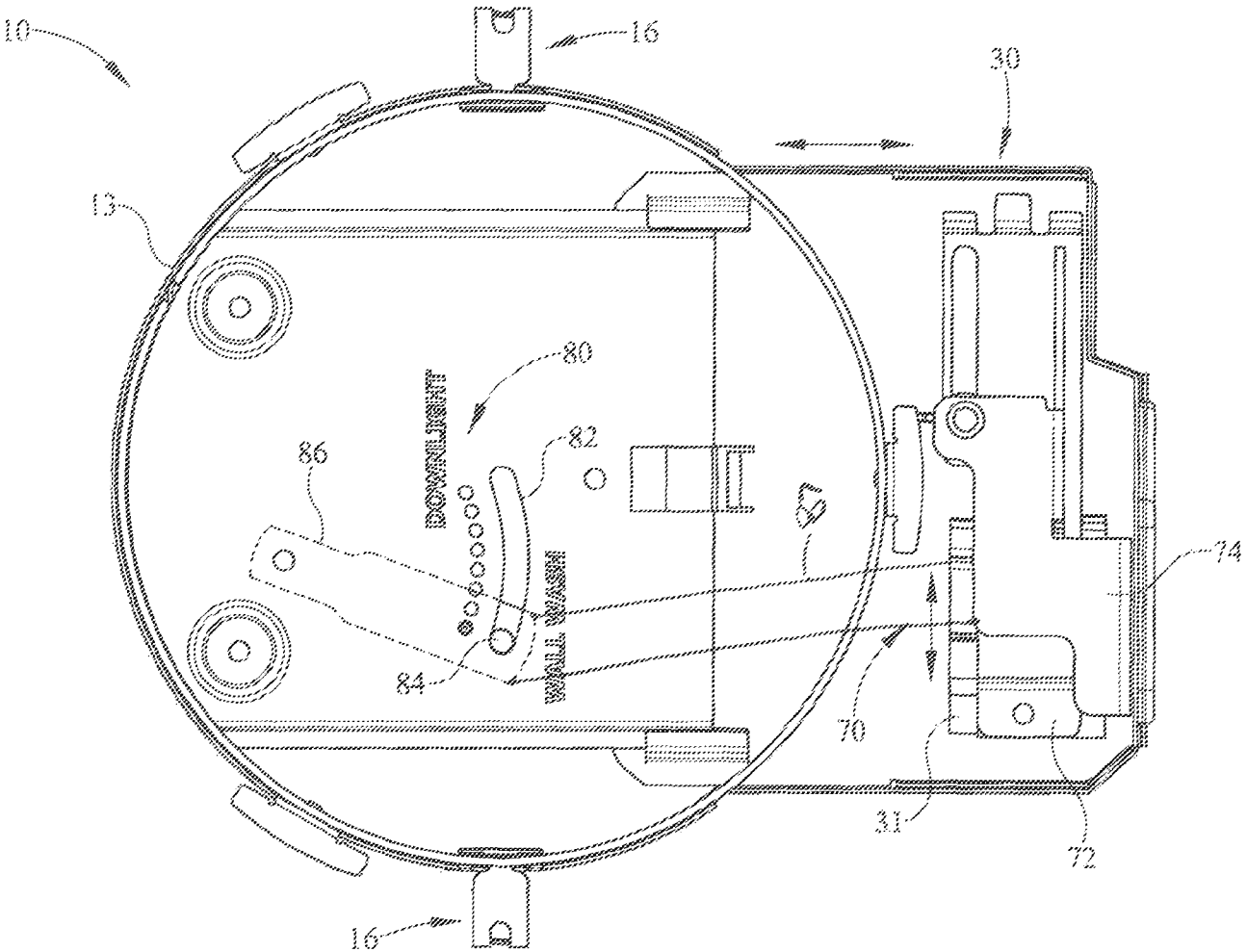
FIG. 9 is a bottom view with the sidewall in an extended position and depicting a socket adjustment assembly in a first position.
Figure 10:
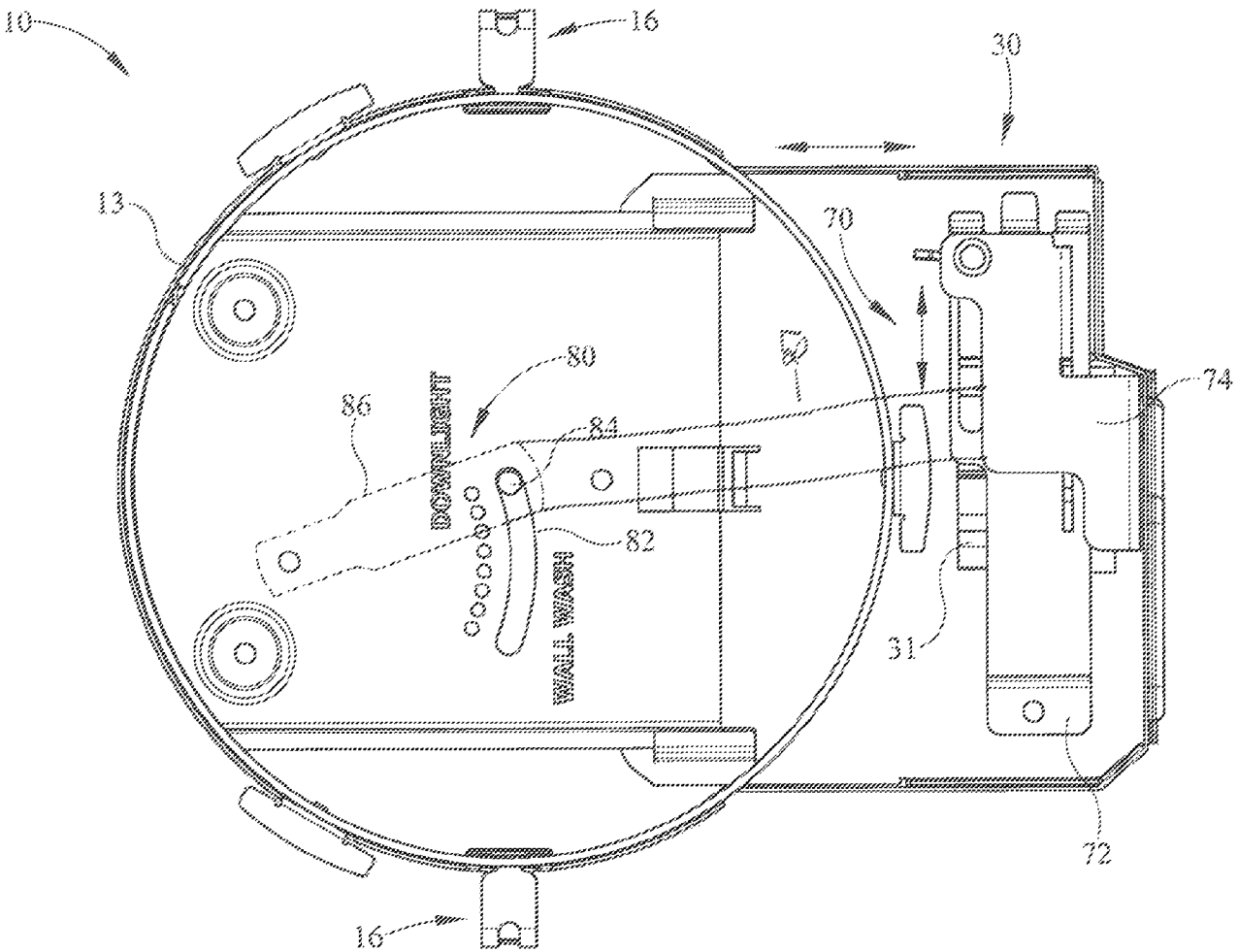
FIG. 10 is a bottom view of the fixture of FIG. 7 with the socket adjustment assembly in a second position.
Figure 11:
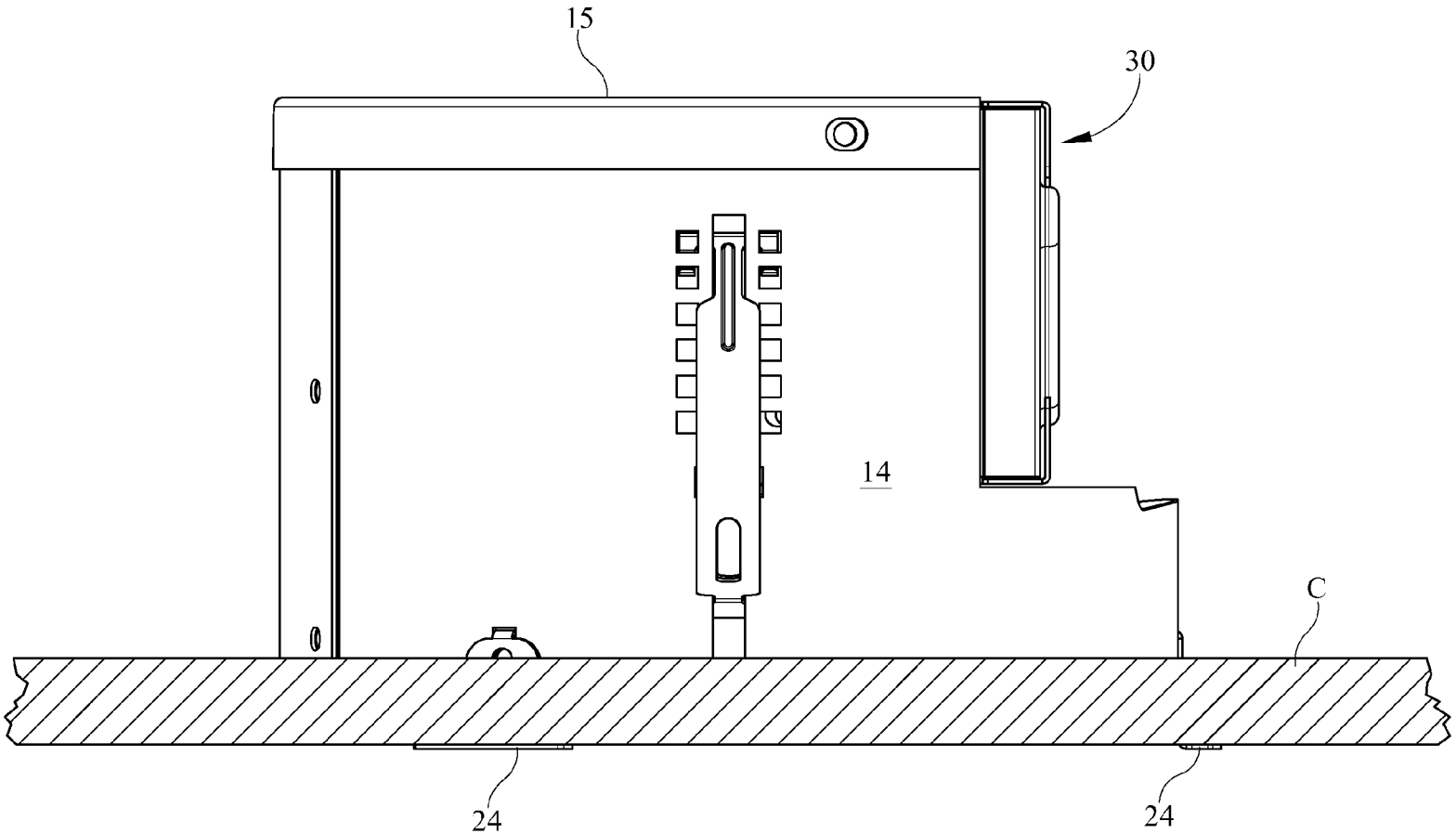
FIG. 11 is a side view of the exemplary fixture of FIG. 2.

Referring initially to FIG. 1, an upper perspective view of a recessed fixture 10 is depicted. The fixture comprises a fixture housing 12 defined by a sidewall 14. The sidewall 14 is generally circular in cross-section, so that the fixture housing 12 is substantially cylindrically shaped. However, alternative fixture housing shapes may be utilized, such as a square housing, rectangular housing or alternate polygonal shapes. For example, as shown in FIG. 11 an alternative square-shaped fixture 10 embodiment is depicted. In either embodiment, the fixture housing 12 further comprises an adjustment mechanism 16 having an upper and lower adjustment portions 18, 20 and a biasing spring 22 utilized to position the fixture 10 above the ceiling surface. At a lower portion of the fixture housing 12 is at least one ceiling tab 24 which abuts at a lower surface of the ceiling C (FIGS. 9, 10). The adjustment mechanism 16 and the ceiling tabs 24 provide for and maintain positioning of the fixture 10 relative to the ceiling, C wherein the fixture 10 is positioned. Adjustment mechanism 16 also allows for use of the fixture 10 with ceiling materials of various thickness.

Figure 5:
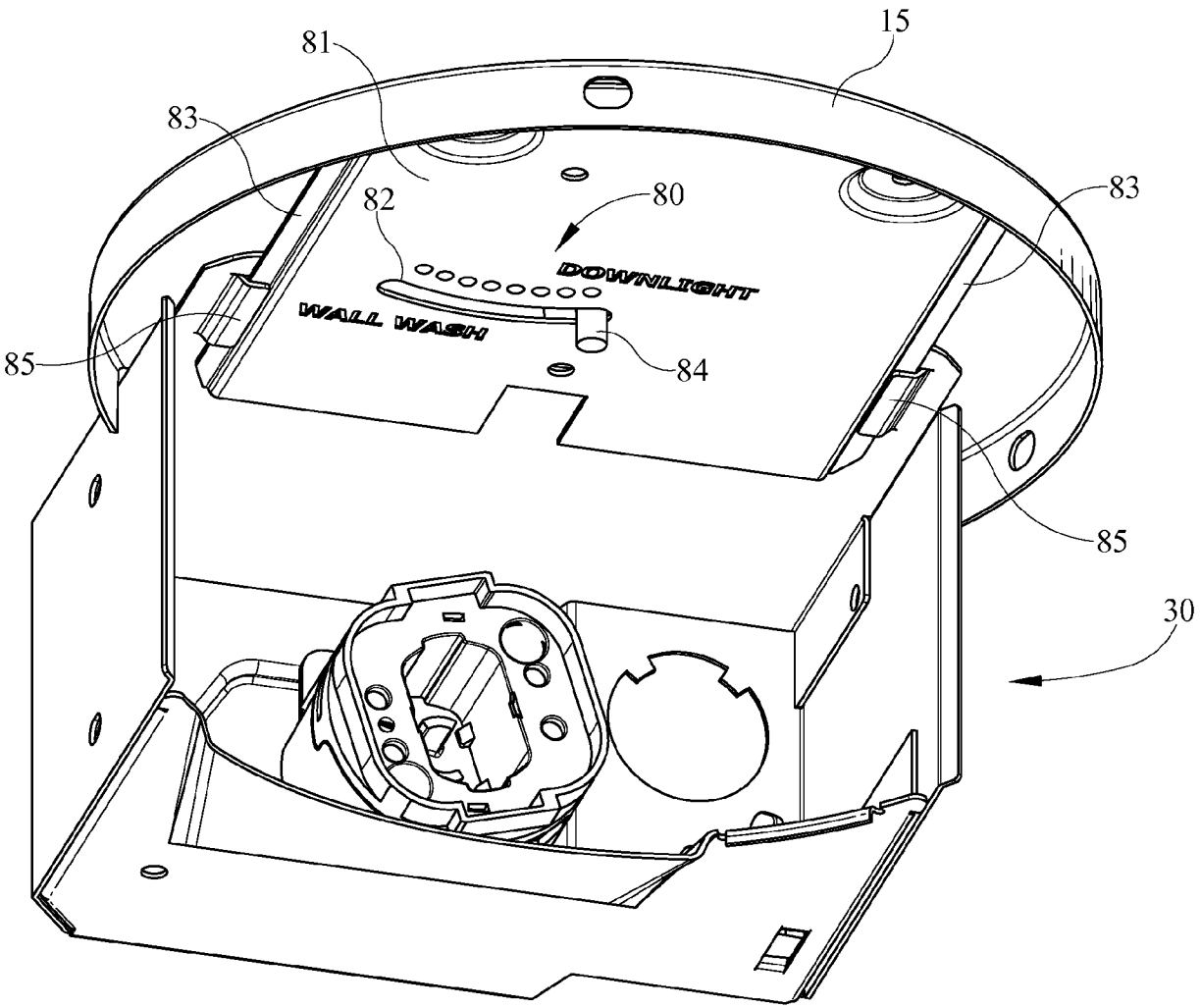
FIG. 5 is a lower perspective view of the movable portion of the housing depicting the second embodiment for sliding the movable portion.

The housing 12 comprises a fixed portion 13 generally defined by the sidewall 14 and a top wall 15 extending over the fixed portion. The top wall 15 may be fixed integrally or may be fastened to the sidewall 14 with fasteners as shown to cover an upper end of the cylindrically shaped housing 12. The lower end is left open for light output as shown in FIG. 5. The housing 12 further comprises a moveable or collapsible sidewall portion 30. The fixed portion 13 includes a sidewall opening 14*a*. The top wall 15 also includes a top wall opening 17. Each of the openings 14*a*, 17 are formed by removing material from the sidewall 14 and top wall 17, respectively. The openings 14*a*, 17 allow collapsible movement of the moveable portion 30 from the extended position of FIG. 1 to an inward or collapsed position shown in FIG. 2.

Referring still to FIG. 1, the collapsible portion 30 includes a top wall 32 and first and second opposed sidewalls 34, 36. Depending from the top wall 32 and extending from the sidewalls 34, 36 is a rear wall 38. The rear wall 38 includes a notched area 40 through which a conduit passes or is connected. Additionally, the rear wall 38 is connected to the first wall 34 by a chamfered corner 42, described further herein. Extending between the rear wall 38 and first and second sidewalls 34, 36 is a lower wall or surface 39, also described further herein.

Figure 2:
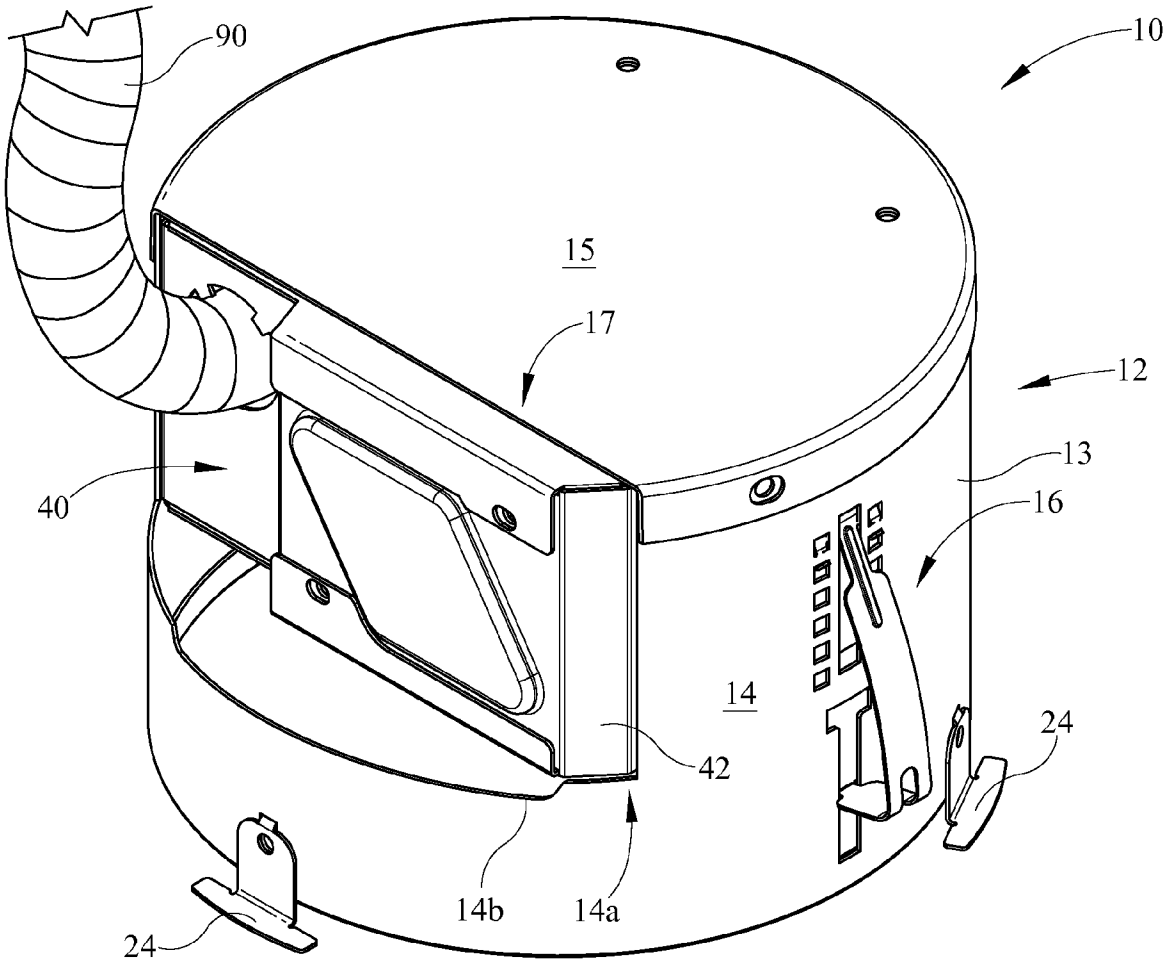
FIG. 2 is an upper perspective view of the fixture of FIG. 1 in a different configuration.
Figure 4:
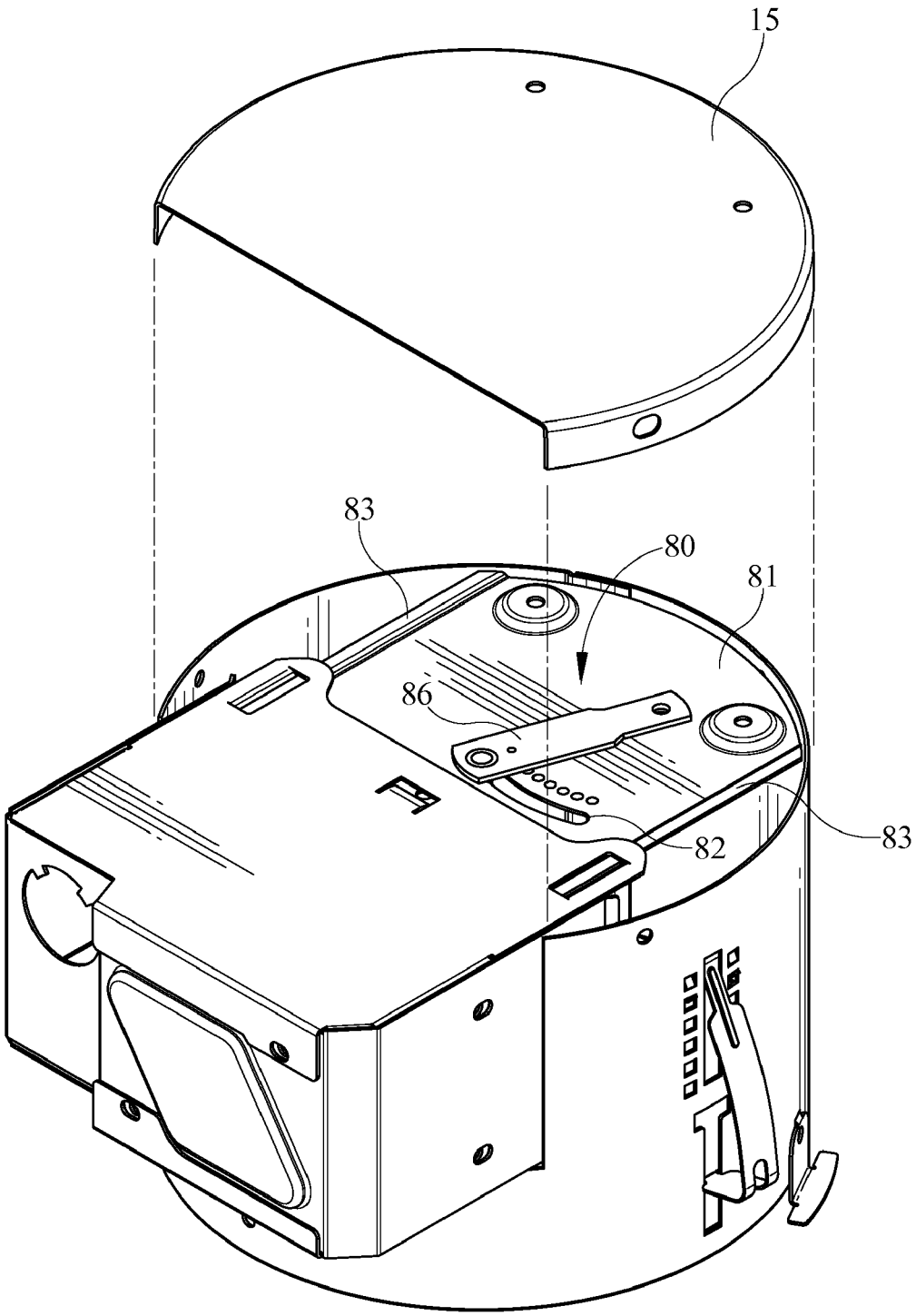
FIG. 4 is an upper perspective view of the fixture of FIG. 1 with the top wall exploded to reveal the reflector adjustment mechanism and a second embodiment for sliding the portion of the fixture housing.

Referring now to FIG. 2, a rear perspective view of the fixture 10 is depicted. This figure depicts the collapsed portion 30 disposed within the fixed portion 13 of housing 12. As seen in FIGS. 2 and 4, the chamfered corner 42 connecting the first sidewall 34 and rear wall 38 (FIG. 1) allows the profile of the collapsible portion 30 to fit within, or not extend beyond, the outer periphery of the housing 12. This aids with installation through the ceiling aperture. The sidewall opening 14*a* includes a lower edge 14*b* which provides a shoulder to support the collapsible portion 30 during sliding motion inwardly of or outwardly from the fixed portion 13.

Also shown in FIG. 2 is a conduit 90 through which a power wire passes to the lamp socket 31 (FIG. 5). The conduit 90 connects to the rear wall 38 at the notched area 40. The notched area is offset from the remaining portion of the rear wall 38 so that a space is provided to curve or radius the conduit without breaking. This allows the fixture 10 to move upwardly through the ceiling with only minimal engagement, if any, between conduit 90 and the ceiling. This is also seen in FIG. 4.

Figure 3:
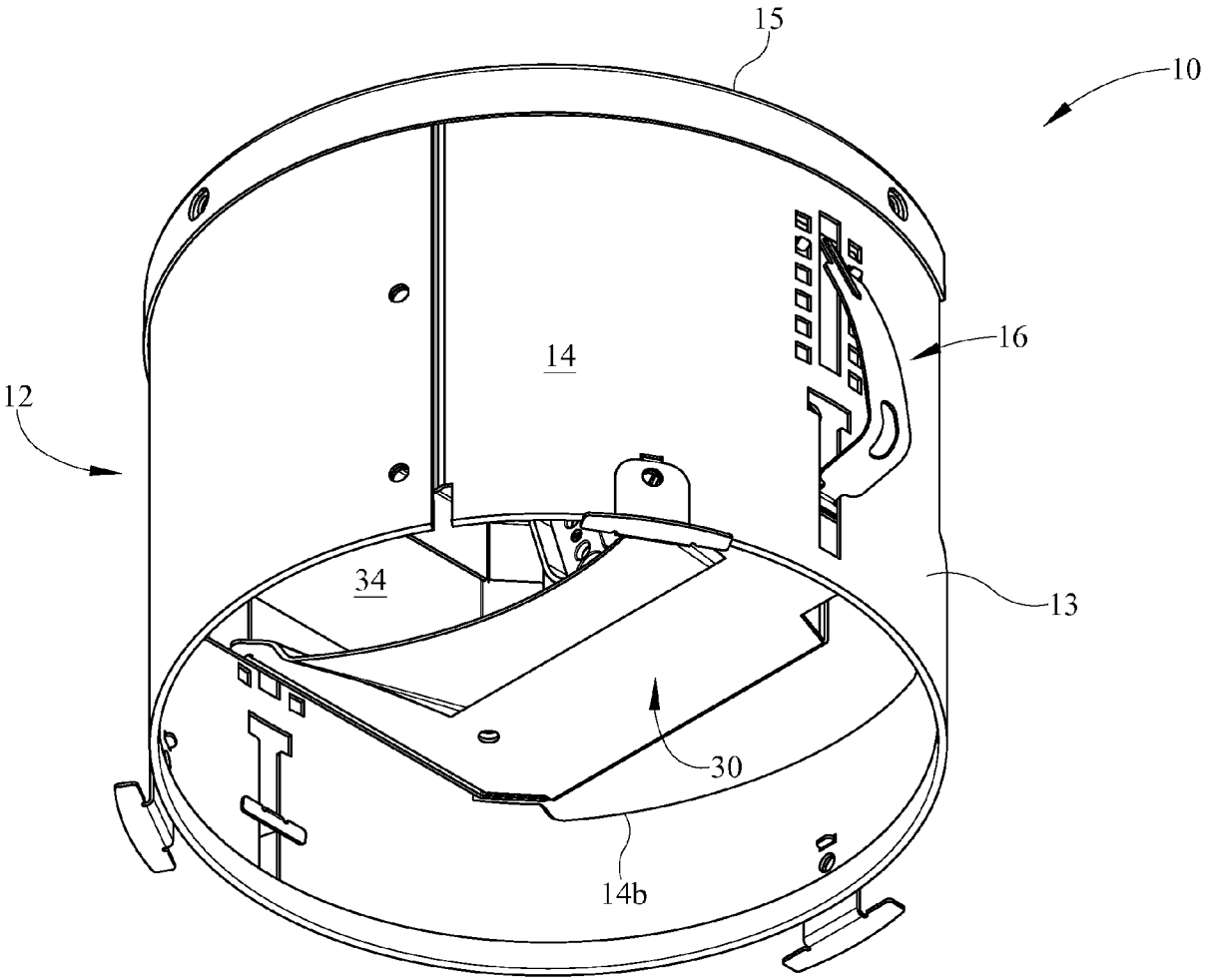
FIG. 3 is a lower perspective view of the exemplary fixture of FIG. 1 depicting a first embodiment of sliding a portion of the fixture housing.

Referring now to FIG. 3, a lower perspective view of the fixture 10 is depicted. In this view, the collapsible sidewall portion 30 is disposed within the fixture housing 12. In this first embodiment of a sliding means, the collapsible portion is shown supported from below along ledge or rail 35 to allow sliding motion into or out of the fixed portion 13. The ledge 35 extends into the housing from lower edge 14*b*. The ledge 35 may be continuous or discontinuous, but in either event provides support for the movable portion 30 within the fixed portion 13. The collapsible portion 30 slides between a first expanded position to a second collapsed position substantially within the periphery of the housing fixed portion 13. Various alternative embodiments may be utilized to provide sliding motion, such as rails which slidably support the movable portion 30, rollers or other means of translation allowing the movable portion 30 to extend from or collapse within the housing 13.

Referring now to FIG. 4, an upper perspective view of the fixture 10 is depicted with the top 15 removed in order to reveal a second embodiment of a sliding means. According to this embodiment, sliding of the movable portion 30 is accomplished by supporting the movable portion 30 from an upper portion of the fixture 10 rather than below the movable portion, as shown in the previous embodiment.

In combination, FIGS. 4 and 5 depict the connection and operation of the second sliding means embodiment wherein a bracket 81 is connected to the top wall 15 by fastener such as a screw or rivet (not shown). Along sides of the bracket 81, rails 83 are defined. The rails 83 are received by tabs 85, which extend from the movable portion 30. In this construction, the rails are received by the tabs 85 which allow the movable portion 30 to slide relative to the bracket 81 and the top wall 15. Additionally, since the top wall is connected to the sidewall 14, the movable portion 30 can therefore slide relative to the fixed portion 13 as a whole.

Additionally, and still referring to FIG. 4, the bracket 81 is generally u-shaped which provides a space for positioning of a reflector adjustment mechanism 80. As described further herein, the reflector adjustment mechanism 80 includes a slot 82 through which a pin 84 moves by way of an arm 86. The varying pin 84 position allows use of different types of reflectors with the fixture 10.

Figure 6:
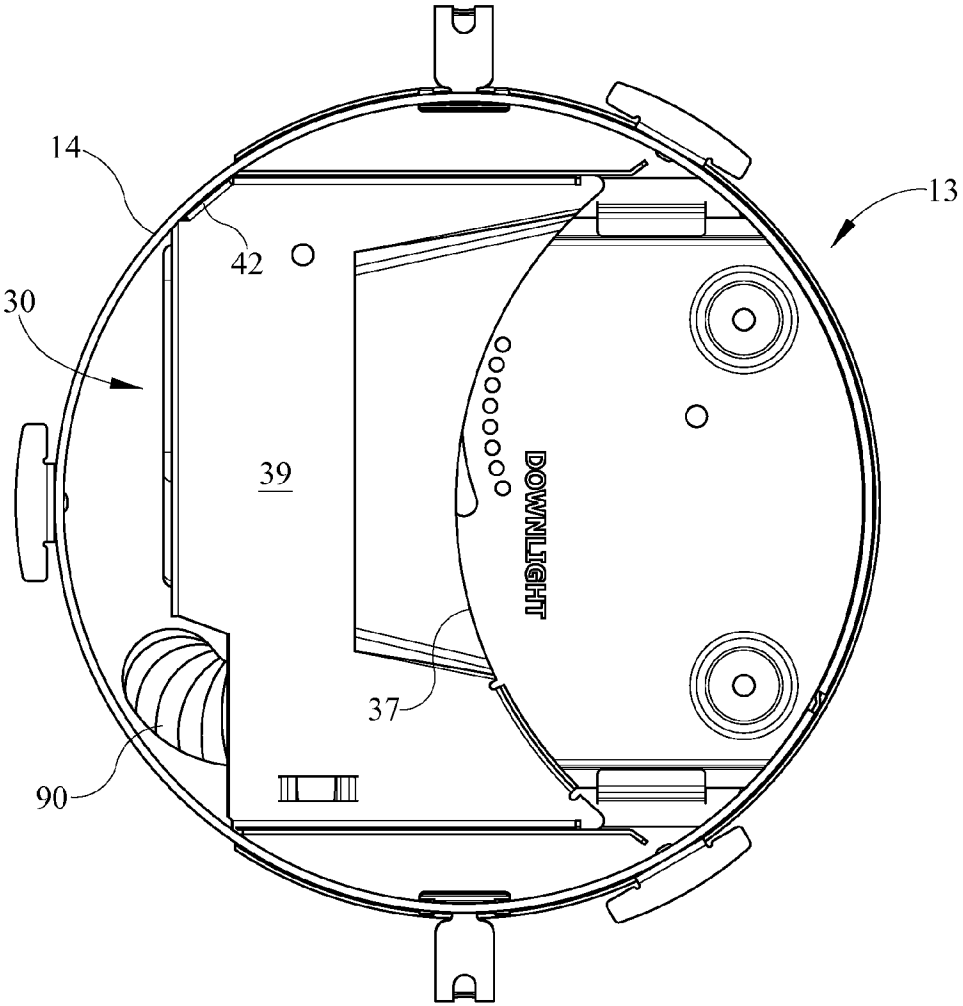
FIG. 6 is a bottom view of the fixture of FIG. 3.
Figure 7:
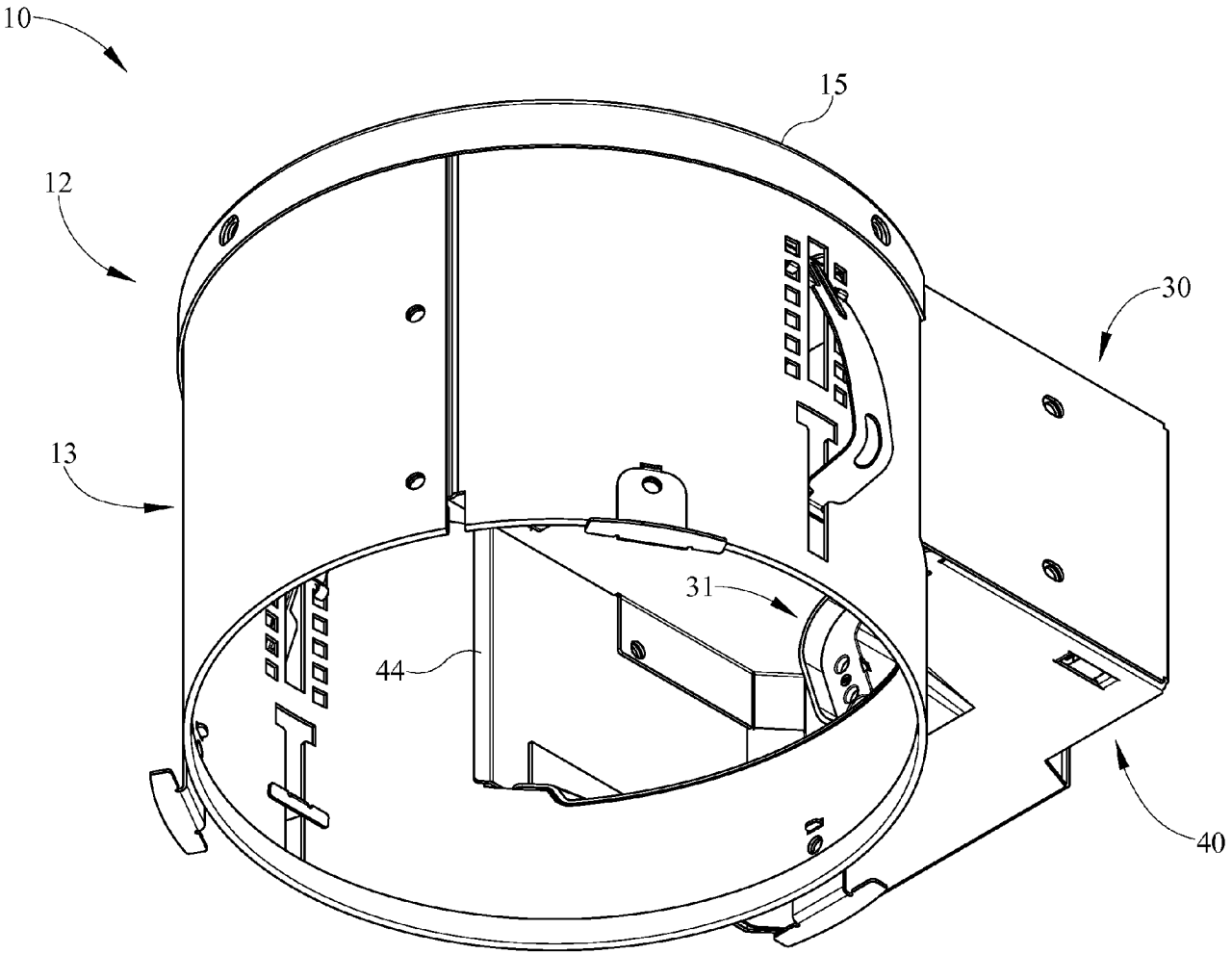
FIG. 7 is a lower perspective view of the fixture with a collapsible sidewall moved to a position corresponding to FIG. 1.

Referring now to FIG. 6, a bottom view of the fixture 10 is shown. A lower surface 39 of the collapsible portion 30 is depicted. Above this lower surface 39 is a socket 31 (FIG. 7). Opposite the rear wall 38, a curved edge 37 is defined. The curved edge substantially approximates the radius of the sidewall 14. When the collapsible portion 30 is extended to the outward position shown in FIG. 1. The bottom view shows the corner 42 which is chamfered to fit within the periphery of the sidewall 14 when the collapsible portion 30 is disposed within the sidewall 14 defining the fixed portion 13. The corner 42 is depicted as chamfered, however alternatively the corner 42 may also be radiused or contoured so as to fit within the sidewall periphery 15.

Referring now to FIG. 7, a lower perspective view of the fixture 10 is depicted with the sidewall portion 30 expanded. The interior cavity of the collapsible sidewall portion 30 includes a lamp socket 31. Various types of sockets may be utilized as required for various lamp types. The socket 31 receives power from a wire existing within the ceiling structure. Since the fixture 10 is depicted as a remodeler fixture, the power input wiring (not shown) may already exist in the plenum area above the ceiling level. The conduit is connected to the collapsible portion 30 in the area of the notch 40. Referring to FIGS. 1, 2, and 6 the notch 40 includes a conduit aperture 41 through which the power wiring passes to electrically connect the socket 31. The notch 40 provides an additional advantage. When the conduit 90 is connected to the movable portion 30, the notch 40 provides a space for a conduit radius so not to damage the conduit, wire or also not damage the surrounding ceiling as the fixture 10 is moved upwardly through the ceiling aperture. The notch 40 may also provide a space to position the conduit 90.

Figure 12:
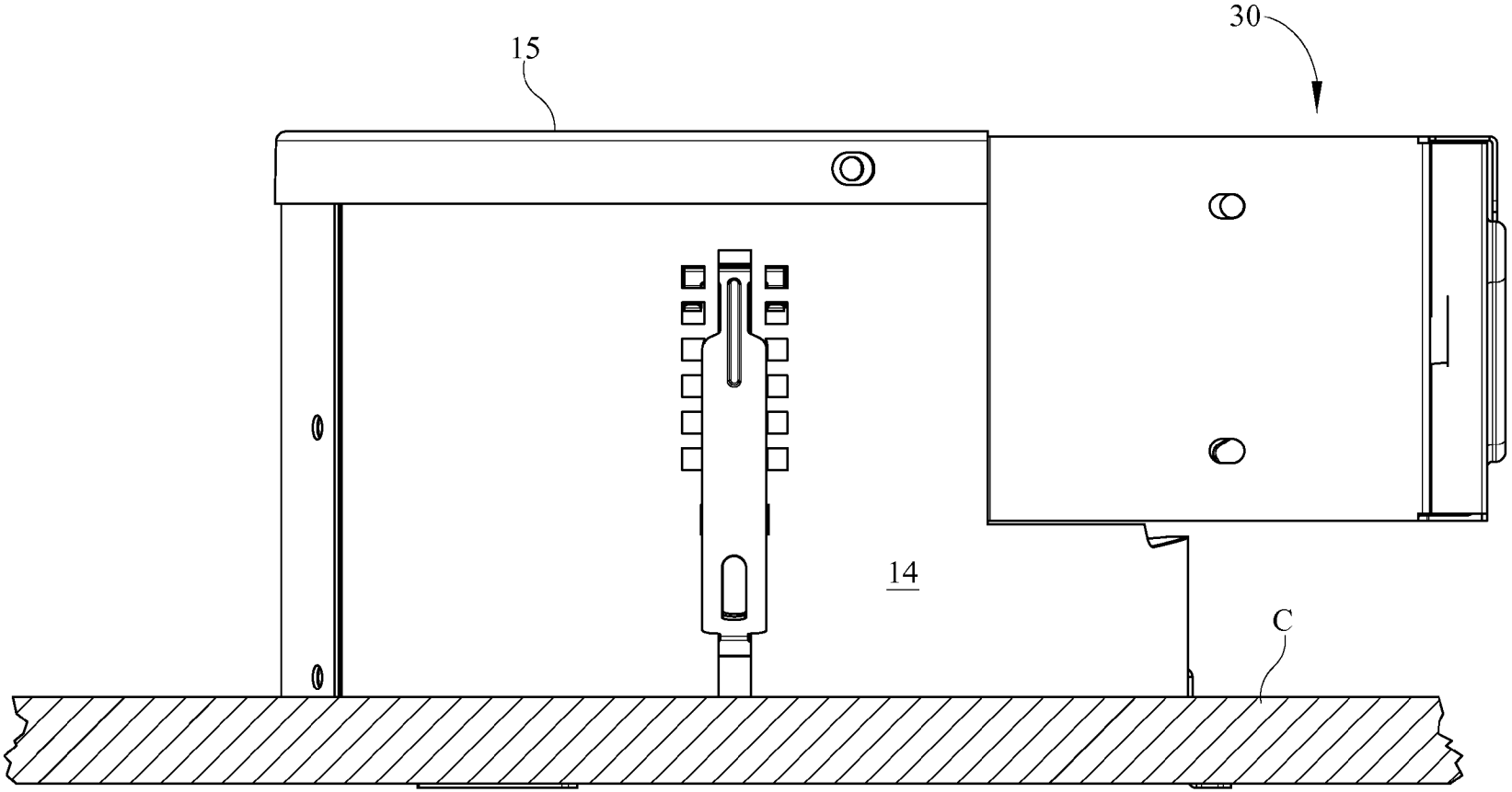
FIG. 12 is a side view of the exemplary fixture of FIG. 1.
Figure 13:
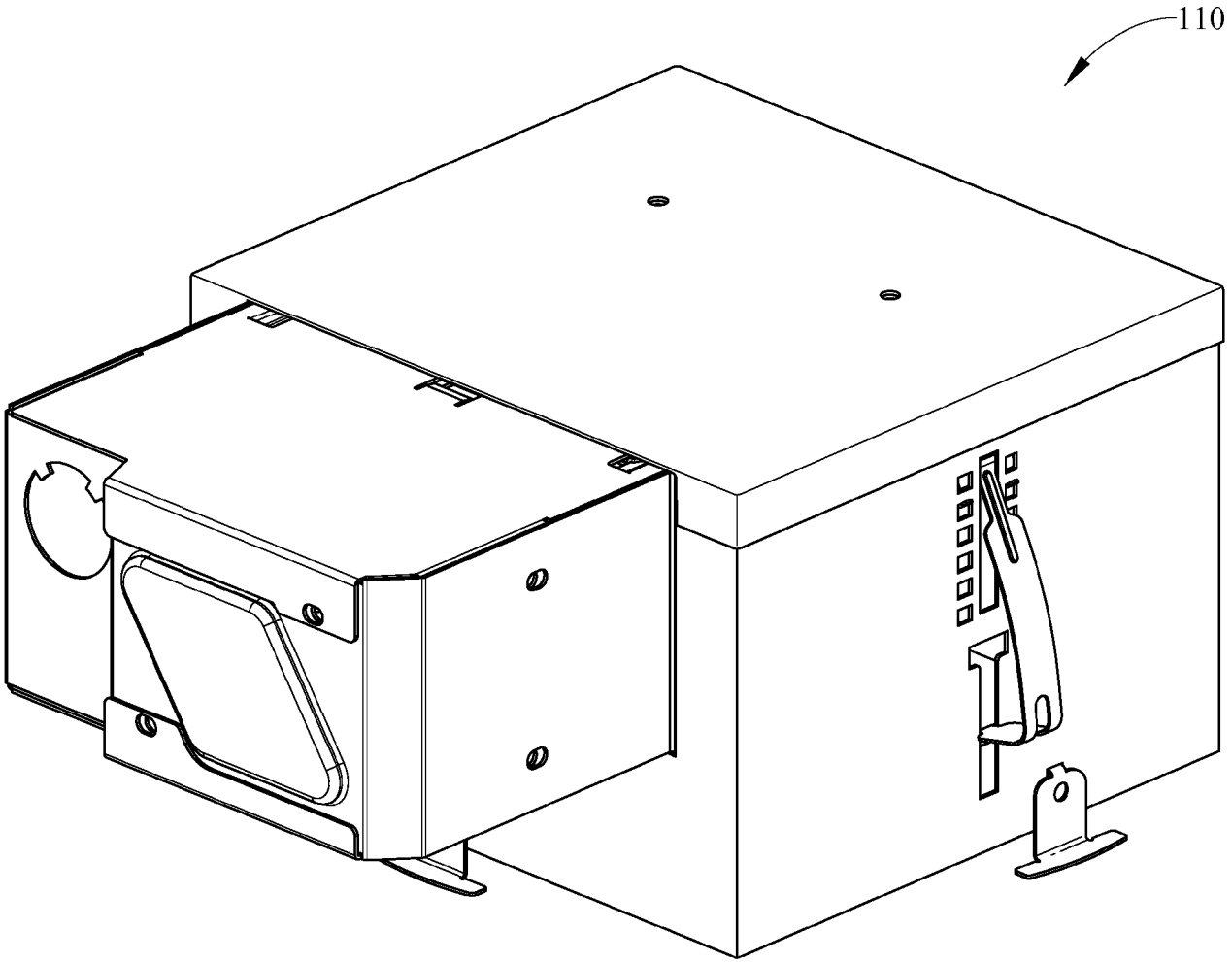
FIG. 13 is a perspective view of an alternative fixture embodiment.

Referring still to FIG. 7, a lip 44 is also shown. The lip 44 which engages an edge of the sidewall opening 14*a* to inhibit the collapsible portion 30 from being removed from the fixture portion 13 inadvertently when the fixture 10 is in the ceiling (FIG. 12).

Figure 8:
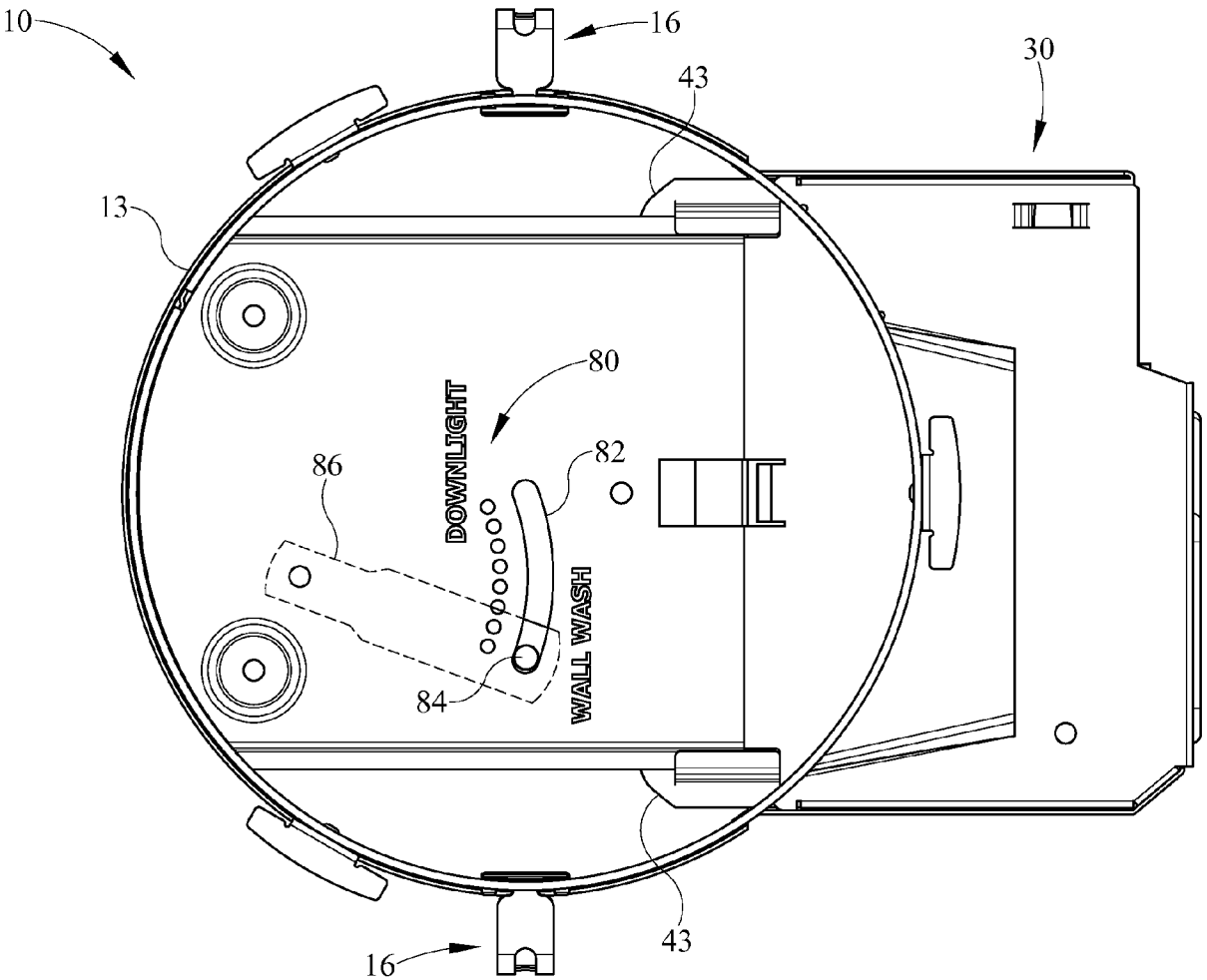
FIG. 8 is a bottom view of the recessed fixture of FIG. 5.

Referring to FIG. 8, a bottom view of the fixture 10 is depicted. The forward tapered corners 43 allow further insertion of the collapsible portion 30 without engaging the housing sidewall 14.

Referring to FIG. 9, a bottom view of the fixture is depicted with the lower surface 39 of the sidewall portion 30 removed. With the inside of the sidewall portion viewable, a socket adjustment mechanism 70 is visible. The socket adjustment mechanism 70 allows for slidable adjustment of the socket 31 in a direction which is transverse to the movement of the sidewall portion 30 as shown by the pairs of double-headed arrows. The movement of the socket 31 in the two dimensions indicated allows for adjustment for various reflector types as well as customized positioning of the lamp (not shown) for improved optical performance. Although the socket adjustment mechanism is shown in combination with a housing having a fixed and moveable portion, the socket adjustment mechanism 70 should be understood to be useable with a non-slidable embodiment of a housing.

The socket adjustment assembly 70 includes a stationary track portion 72 along which a socket carriage 74 slides. The socket carriage 74 moves in a direction from top to bottom, and vice-versa, of the figure depicted. In actuality, when the fixture 10 is positioned in a ceiling, the movement of the carriage 74 will be in a horizontal plane. In the position specifically depicted in FIG. 10, the socket adjustment assembly 70 is positioned for use with a wall wash reflector. Although this single embodiment of an adjustment assembly 70 is shown and described, various alternative embodiments may be utilized and are considered to be within the scope of the present invention. Additionally, it is contemplated that a second track or alternate means could be provided for allowing the carriage 74 to move along a vertical plane if desired and depending on the type of reflector or style of housing the socket assembly 70 is utilized with.

Also shown in FIG. 9 is the reflector adjustment mechanism 80. The reflector adjustment mechanism 80 allows for use of different reflectors. For example, a downlight reflector 60 (FIG. 14) may be used or a wall wash reflector 160 (F*igure* 15). Other types of reflectors may also be used and therefore these exemplary types should not be considered limiting. The reflector adjustment mechanism 80 is shown in a first position corresponding to use with a wall wash reflector. The adjustment mechanism 80 comprises a slot 82 and a pin 84 which moves through the slot 82. An arm 86, depicted in broken like, provides structure for movement of the pin 84 through the slot 82. During installation, the arm 86 is moved to one of the wall wash or the downlight positions, depending on the type of reflector being used. As currently depicted, the pin 84 is moved to a first position for use with a wall wash reflector. Either, before or after, the socket adjustment mechanism 70 is adjusted to move socket 31 to a position corresponding to the reflector type used. As currently shown, the reflector adjustment mechanism 80 and the socket adjustment assembly 70 move independently of one another. However, the reflector adjustment mechanism 80 and socket adjustment assembly 70 may be interlocked 87 or otherwise connected so that movement of one assembly causes movement of the other assembly to corresponding positions, based on the type of reflector being utilized.

Referring now to FIG. 10, a second bottom view of the fixture 10 is depicted. In this view, the pin 84 is moved to a second, downlight position and the socket 31 is moved to a corresponding position for use with a downlight reflector. In either of the positions depicted, the pin 84 is received by a reflector of appropriate type for the indicated pin position.

Referring now to FIG. 11, a side elevation view, the housing 12 is depicted with the movable portion 30 disposed within the periphery of the housing sidewall 14 and the top wall 15. In this position, the fixture 10 may be moved upwardly through an aperture in the ceiling C. This fixture allows for use as a remodeler fixture which does not require access above the ceiling in order to install. Once the collapsible portion 30 is disposed above the ceiling C, the portion 30 may be expanded.

Referring now to FIG. 12, the fixture is again depicted in the side elevation view. The sidewall portion 30 is extended outwardly since the movable or collapsible portion 30 is above the ceiling level. This properly positions the socket 31 in at least one dimension. Once expanded, the socket 31 (FIG. 7) is properly positioned with respect to the lower housing or light output aperture and the socket 31 may then be adjusted in the transverse direction for an appropriate reflector type.

Figure 14:
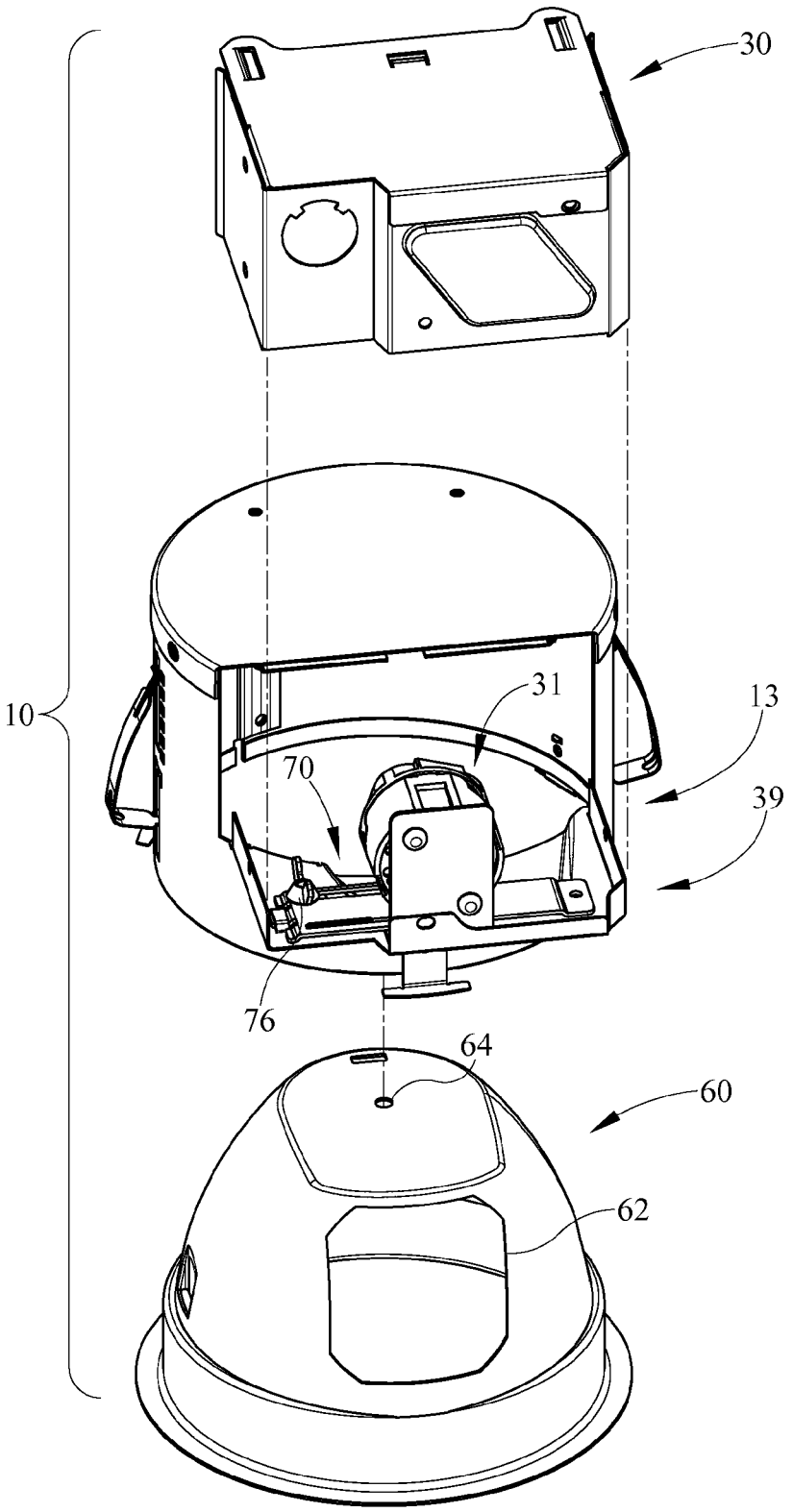
FIG. 14 is an exploded perspective view of the exemplary fixture including a first reflection type; and, FIG. 15 is an exploded perspective view of the exemplary fixture including a second reflector type.

Referring now to FIG. 14, an exploded perspective view of the fixture 10 is depicted. The movable portion 30 is shown exploded from the fixed housing 13. However, the lower surface 39 is not exploded from the fixed housing portion 13. The socket 31 is shown on the socket 31 is shown on the socket adjustment mechanism 70 for movement the fixed portion 13. Beneath the lower opening of the fixed portion 13 is a reflector. The reflector 60 includes a side aperture 62 for receiving a lamp from the lamp socket 31 there through. The upper portion of the downlight reflector 60 has an aperture 64 which aligns with pin 84 (FIG. 10) when the pin is in the downlight position for receiving such reflector-type. The downlight reflector 60 may be formed of various materials and will be understood by one skilled in the art. It may have a specular or diffusive finish on the inside surface thereof for reflection of light from the lamp.

Figure 15:
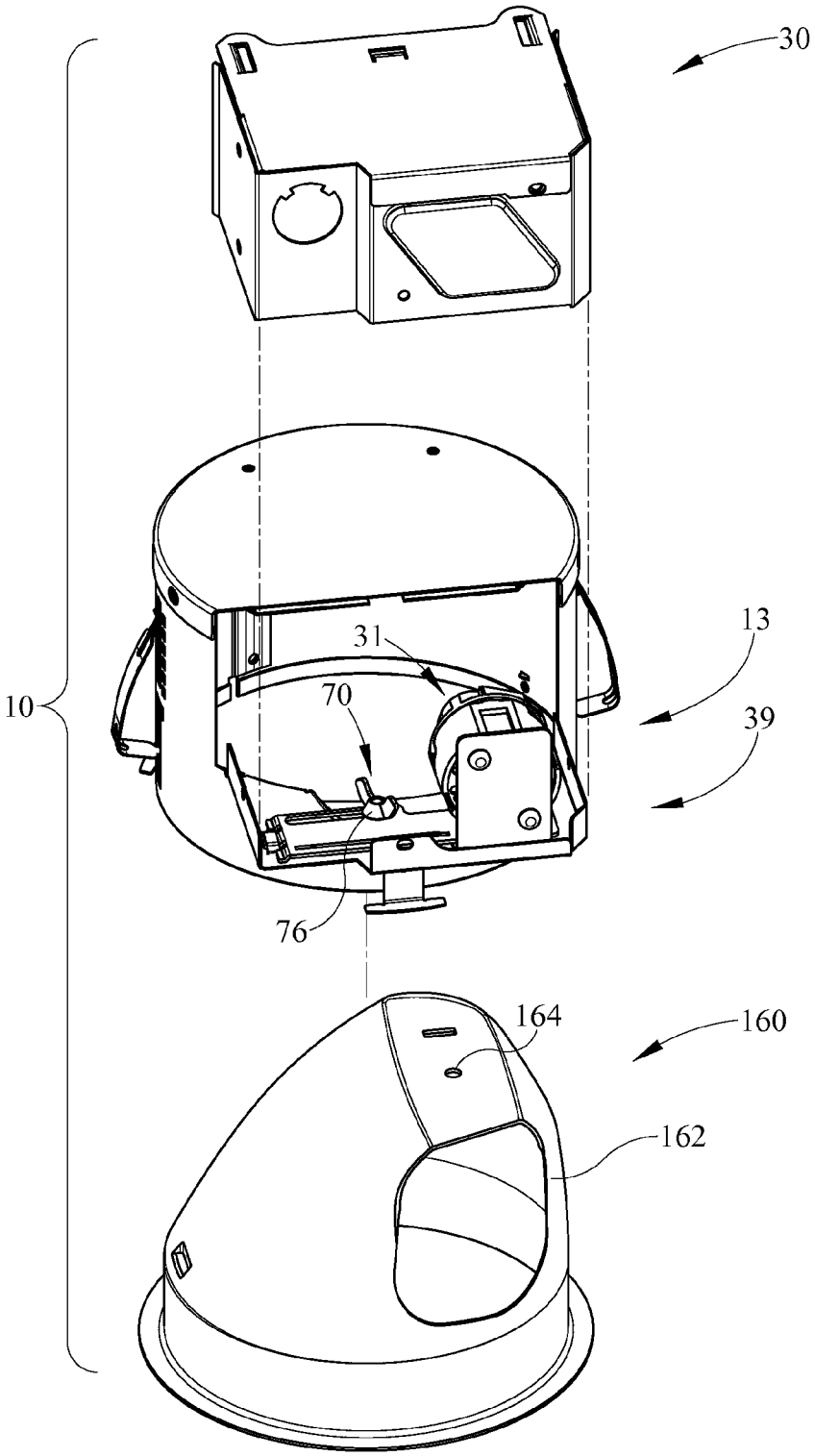

Referring now to FIG. 15, an exploded view of the light fixture 10 is also depicted with an alternate wall wash reflector 160 shown. The wall wash reflector 160 includes an aperture, which is not centered, which is proper for use with the lamp socket 31 in a specific position. As shown in comparing FIGS. 14 and 15, the reflector apertures 62, 162 are not in the same position, thus requiring the socket adjustment assembly 70 to allow movement of the lamp socket 31 and the lamp (not shown). Also shown in FIG. 15, in the upper surface of the reflector 160 is an aperture 164 which receives pin 84 when the pin is appropriately positioned for the wall wash reflector 160. Thus, the assembly 80 inhibits the use of an inappropriate reflector type with the fixture 10.

Also shown in FIGS. 14 and 15 is wing nut 76, which, when loosened, allows movement of the socket assembly 13. When the socket 31 position is determined, the wing nut 76 is tightened to inhibit further movement of the slide carriage 74 and socket 31.

The foregoing description of several embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A recessed luminaire with adjustable socket assembly comprising:

a housing having a sidewall, a top wail and a lower opening allowing light output;

a socket adjustment assembly disposed in said housing, said socket adjustment assembly having:

a lamp socket connected to a socket carriage;

a track having a socket carriage movably positioned on said track;

wherein said carriage moves along said track and said lamp socket is movable in at least one of a vertical or a horizontal direction, and a reflector adjustment assembly which is movable to a first or second position corresponding to a first or second position of said socket adjustment assembly.

2. The recessed luminaire of claim 1, further comprising a wall wash reflector disposed said housing.

3. recessed luminaire of claim 2, said lamp socket and carriage disposed in one of a first position and a second position corresponding to a lamp aperture position of said wall wash reflector.

4. The recessed luminaire of claim 1 further comprising a downlight reflector.

5. The recessed luminaire of claim 4, said lamp socket and carriage disposed in one of a first position or a second position corresponding to a lamp aperture position of said downlight reflector.

6. The recessed luminaire of claim 1, said reflector adjustment mechanism having a pin which is movable from the first position to the second position.

7. The recessed luminaire of claim 6, said pin connected to an arm, said arm allowing guided movement of said pin through a slot.

8. A recessed luminaire with movable lamp socket, comprising:

a housing having a lowermost opening defined by a sidewall, a top wall positioned across an upper portion of said housing to enclose said housing;

an adjustable socket assembly including said lamp socket disposed on a movable carriage, said carriage connected to a track for movement in at least one plane;

said lamp socket movable from a first position to a second position, one of said first and second positions corresponding to a first reflector and the other of said first and second positions corresponding to a second reflector, and a reflector adjustment assembly which is movable a first or second position corresponding to the first or second position of said socket.

9. The recessed luminaire of Claim 8, said reflector adjustment mechanism having a movable pin which slides through a slot from the first position to the second position.

10. The recessed luminaire of claim 8, said first reflector being one of a wall wash reflector and a downlight reflector.

11. The recessed luminaire of claim 10, said second reflector being the other of said wall wash reflector and said downlight reflector.

12. A recessed luminaire with a lamp socket assembly allowing movement of a lamp socket, comprising:

a housing having a sidewall, a lower opening and a removable top wall;

said lamp socket assembly being adjustable to receive a first e type and a second reflector type;

said adjustable lamp socket assembly having a fixed portion and a movable portion, said lamp socket connected to said movable portion, said socket being movable from a first position corresponding to a first reflector type to a second salon corresponding to second reflector type;

a reflector adjustment chanis having a first position also corresponding to said first reflector type and a second position corresponding to said second reflector type.

13. The recessed luminaire of claim 12, said adjustable lamp socket assembly and said reflector adjustment mechanism being interlocked so that movement of said adjustable lamps socket assembly causes movement of said reflector adjustment mechanism.

14. The recessed luminaire of claim 12, said adjustable lamp socket assembly and said reflector adjustment mechanism each being movable independently of the other.

* * * * *